US005907932A

United States Patent [19]

LeConte et al.

[11] Patent Number: 5,907,932

[45] Date of Patent: Jun. 1, 1999

[54] WALL STRUCTURE HAVING ENHANCED SOUND TRANSMISSION LOSS

[75] Inventors: Alain LeConte, Houille, France; Ronald Moulder, Norristown, Pa.

[73] Assignee: CertainTeed Corporation, Valley Forge, Pa.

[21] Appl. No.: 08/905,228

[22] Filed: Aug. 1, 1997

[51] Int. Cl.[6] ..... E04B 1/82

[52] U.S. Cl. ..... 52/144; 52/238.1; 52/479; 181/210; 181/284; 181/290

[58] Field of Search ..... 52/144, 731.5, 52/731.9, 733.2, 736.1, 736.2, 238.1, 479, 573.1; 181/210, 284, 285, 286, 290

[56] References Cited

U.S. PATENT DOCUMENTS

| | | | |
|---|---|---|---|
| 2,131,485 | 9/1938 | Schwensen et al. | 52/144 X |
| 5,136,821 | 8/1992 | Child | 52/144 X |
| 5,272,284 | 12/1993 | Schmanski | 52/144 X |
| 5,426,267 | 6/1995 | Underhill et al. | 52/144 X |

FOREIGN PATENT DOCUMENTS

| | | | |
|---|---|---|---|
| 4038423 | 6/1992 | Germany | 52/144 |
| 1249121 | 7/1986 | U.S.S.R. | 52/238.1 |

*Primary Examiner*—Creighton Smith
*Attorney, Agent, or Firm*—Alexander H. Plache

[57] ABSTRACT

A permanent stud wall structure having improved sound transmission loss comprising two substantially parallel rows of spaced apart vertically extending support members secured at their ends to a base and header respectively by appropriate means and defining a stud cavity; said vertically extending support members being located in each of said rows such that there is a corresponding support member in the other row that is in substantially the same plane running perpendicular to said rows; one or more horizontally extending relatively rigid support members extending between one or more corresponding vertically extending support members and being secured to said vertically extending support members by appropriate securing means; said horizontally extending members including a vibration isolator means to reduce the transmission of sound between opposite ends thereof; and one or more layers of a covering material secured to the outwardly facing surfaces of one or more of said vertically extending support members such that said covering material extends in a plane that is substantially parallel to said rows of spaced apart vertically extending support members.

15 Claims, 3 Drawing Sheets

WALL STRUCTURE HAVING ENHANCED SOUND TRANSMISSION LOSS

FIELD OF THE INVENTION

The subject invention relates to permanent wall structures providing a high sound transmission loss. Such structures function to reduce the transmission of noise, sound and vibration from one room to an adjacent room . More specifically, in one embodiment, the subject invention relates to a wall structure which includes two generally parallel, spaced apart rows of steel stud framing having insulation material there between and being attached together with a plurality of fasteners which include a sound isolator having a high vibration loss factor.

BACKGROUND OF THE INVENTION

Conventional permanent wall systems utilized in building structures often consist of a stud frame typically made of wood or steel upon both sides of which an appropriate facing or covering—plaster, dry wall, gypsum board or other material—is vertically mounted. Wood stud frames are commonly utilized for residential and light commercial construction, while steel stud frames are frequently employed in commercial applications requiring greater strength, fire rating, or other attributes which steel imparts to the structure. Wood is susceptible to water and insect damage, rotting and fire. In fact, in many locations the use of wood stud framing is prohibited for some applications by building codes for safety reasons.

In applications where conventional wood or steel stud framing is employed, somewhat improved resistance to sound transmission ( increased sound transmission loss) can be achieved by incorporating an appropriate insulation material in the stud cavity. The stud cavity being defined herein as encompassing the total air space between and surrounding the stud framing once an appropriate facing or covering is mounted thereto.

For certain applications the use of conventional stud framing incorporating insulation within the wall cavity does not adequately reduce the transmission of sound through the wall because the framing itself permits the transmission of sound and vibrations through the wall. Accordingly, there is a need for a wall system utilizing steel or wood stud framing and having a substantially improved sound transmission loss. Such a system would be particularly useful in situations in which the use of steel is required or called for and where it is desirable to minimize the transmission of sound, noise or vibration from one room into an adjacent room, for example in a multiplex movie theater complex in which patrons in adjacent theaters separated only by a wall are watching different movies.

During the past few decades many multiplex movie theater complexes have been constructed throughout North America. These complexes often contain six, eight or more discrete screening rooms frequently separated by only a wall. These complexes have virtually replaced the traditional American movie house which often had only one large screening area. Frequently, the wall systems utilized in multiplex theaters have limited sound transmission loss thereby enabling the patrons watching a movie to hear the movie being shown in an adjacent room.

Another application for which such a system would be beneficial is a conference center in which various programs are taking place in adjacent rooms at the same time. Hotels, motels, apartment complexes and office buildings would also benefit if such a system were employed. Other uses or applications for such a wall system will be readily apparent to those interested in reducing the transmission of sound between rooms or areas separated by a wall.

Wall systems incorporating the use of either wood or steel stud framing will benefit from the use of the subject invention, although the invention is particularly beneficial in construction which utilizes steel framing.

SUMMARY OF THE INVENTION

The present invention comprises a wall structure having significantly improved sound transmission loss which includes two spaced apart parallel rows of stud framing appropriately secured to a supporting base of a building structure and further including a plurality of relatively rigid support members extending laterally between the two rows of said stud framing at periodic intervals and secured thereto by appropriate means, said rigid support members including a vibration isolating means to effectively reduce the transmission of sound or vibration through the laterally extending support members. An insulation material having desirable acoustical properties is, in one embodiment, positioned in the air space between the stud frames and in the stud cavity. Acoustical insulation comprises any material with interconnecting air cells such as fiber glass, mineral wool, foam and cellulose. One or more layers of an appropriate covering are subsequently attached to the outwardly facing surfaces of the vertical members to form substantially continuous outer wall surfaces.

DETAILED DESCRIPTION OF THE INVENTION

Figure 1:
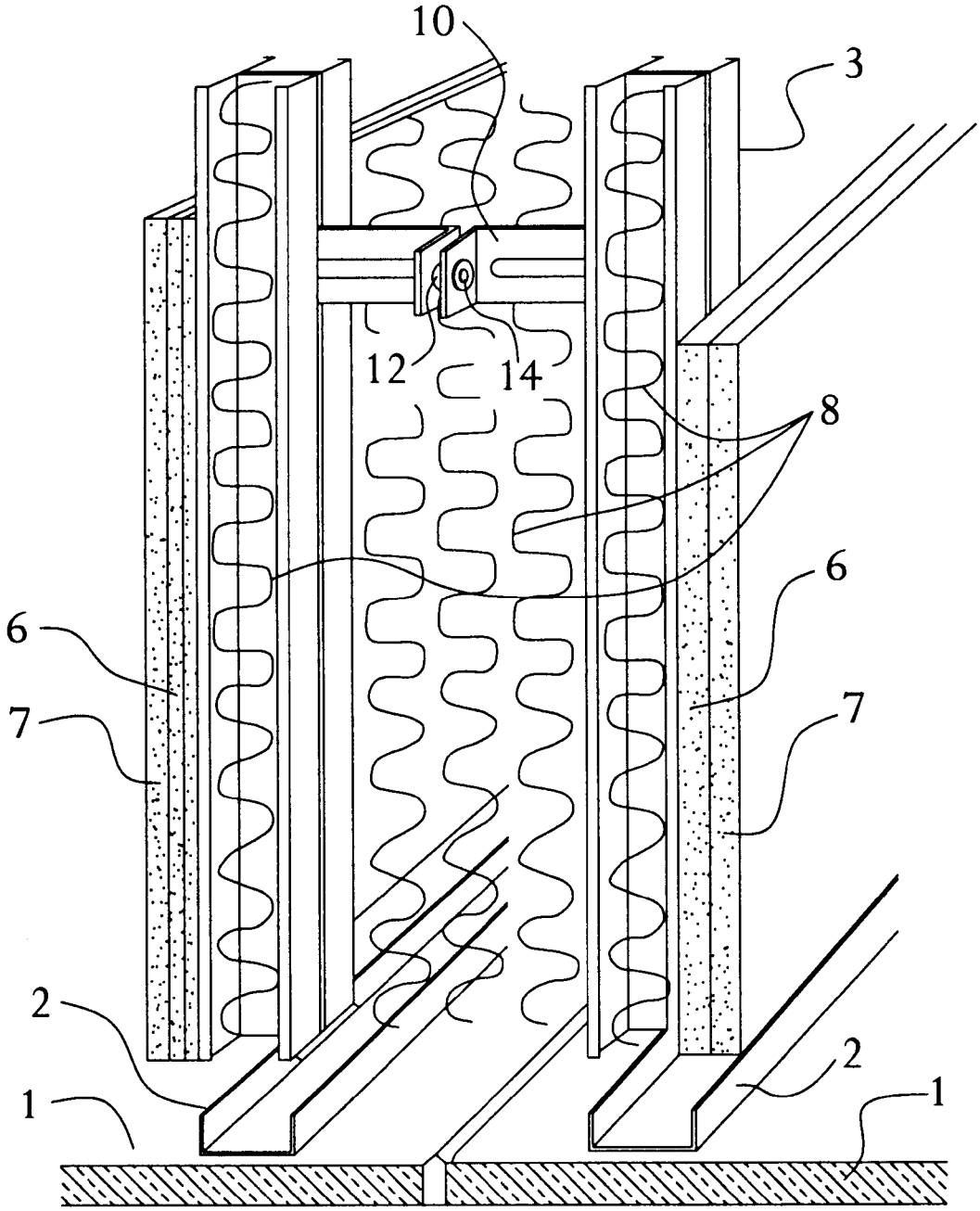
FIG. 1 is a perspective view of an embodiment of a wall structure incorporating the present invention.
Figure 2:
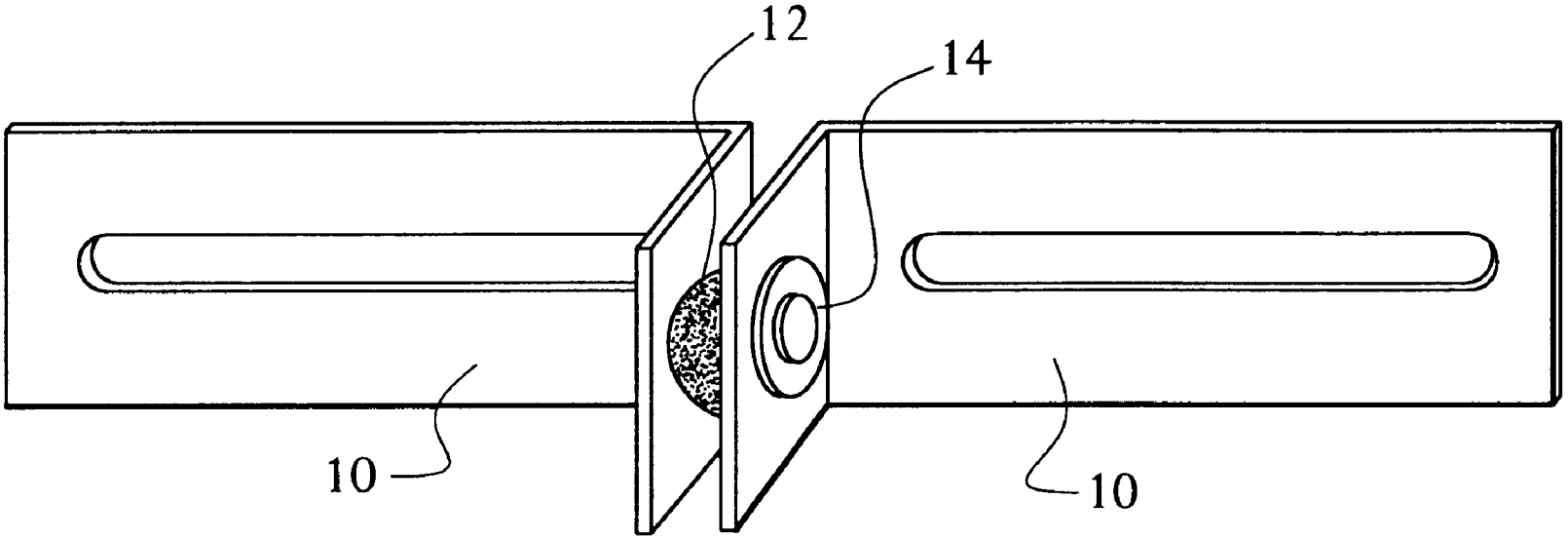
FIG. 2 is an enlarged perspective view of a laterally extending rigid support member incorporating a vibration isolator in accordance with the present invention.

FIGS. 1 and 2 show a preferred embodiment of a wall system incorporating the features of the present invention. In use as a wall structure, longitudinally extending mounting rails 2 are secured to base 1 and to corresponding header rails located at the top of the wall (not shown) in substantially parallel relationship to each other by appropriate securing means. A plurality of vertically extending support members 3 are thereafter secured to rails 2 by appropriate means at periodic locations along the length of said rails such that corresponding members on each rail are located in the same plane perpendicular to said rails. Vertically extending members 3 are secured to each other by periodically spaced horizontally extending support members 10 which, in the illustrated embodiment comprise two opposed sections separated by a vibration isolator means 12 secured by appropriate securing means 14 between said opposed sections of support means 10. Said vibration isolator means 12 functions to reduce the transmission of sound or vibrations between vertically extending members 3 located at the opposed distal ends of said horizontally extending support member 10. Sufficient acoustical insulation material 8, preferably fiber glass batts or blankets, may be placed between the two rows of vertically extending members and in the stud cavity to further reduce the transmission of sound through the structure and one or more layers of gypsum wall board or other desirable covering material 6 and 7 are secured to the outwardly facing surfaces of said vertically extending members 3 by appropriate means to form outer walls of the structure.

Vibration isolator 12 can be made of any number of materials having a high vibration loss factor and which will preferably not significantly detract from the overall rigidity of the horizontally extending support members. Suitable materials include soft rubber, neoprene, foam, fibrous mineral wool, certain plastic materials or the like. As shown in FIGS. 3–7, the structure of the isolator may vary so long as the utilized structure is not materially detrimental to the overall stability and strength of the structure.

The utilization of horizontally extending support members permits each of the rows of stud framing to be of a lighter duty than would be required if only one row of stud framing were utilized because the bridging of the two rows adds significant strength and stability to the overall structure. The improved performance obtained from the use of vibration isolator means in combination with the use of insulation material having enhanced acoustical performance along with multiple layers of wall board or other material justifies any additional costs associated with the structure where a reduction in sound transmission through the structure is of primary importance.

The structure of a preferred embodiment of the horizontally extending support member 10 incorporating a vibration isolator means 12 is shown in expanded view in FIG. 2. As can be seen in FIG. 2, vibration isolator means 12 is secured between opposing sections of support member 10 by securing means 14 which, in FIG. 2 comprises a bolt which extends through isolator means 12 and is secured by appropriate means to the opposite section of support member 10.

Figure 3:
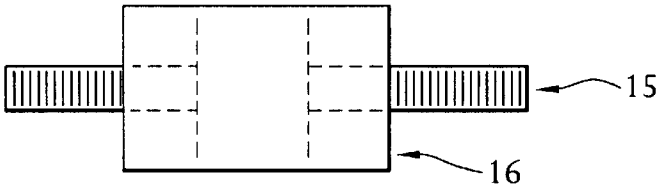
FIGS. 3–7 depict, merely by way of illustration, various embodiments of vibration isolators which may be employed in the present invention.
Figure 4:
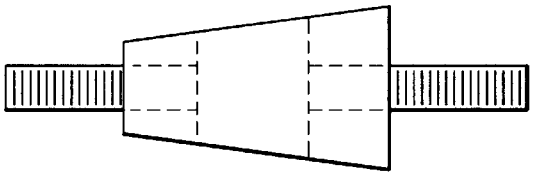
Figure 5:
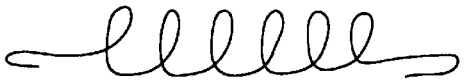
Figure 6:
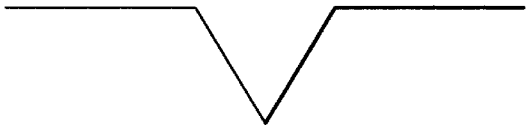
Figure 7:
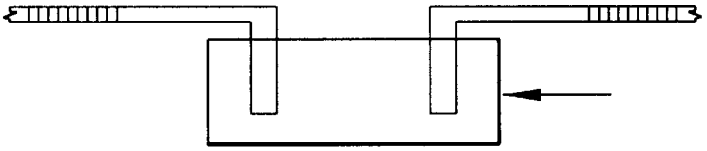

Alternative embodiments of vibration isolation means 10 are illustrated in FIGS. 3 –7. In FIG. 3 threaded members 15 are embedded or otherwise secured to isolation means 16 which can be made of rubber or other material having a high vibration loss factor without sacrificing significant rigidity to the horizontally extending support member. FIG. 4 shows an alternative structure of the isolation means and threaded members depicted in FIG. 3. In FIG. 5, the vibration isolation means comprises a spring member having sufficient stiffness to preserve adequate rigidity to the horizontally extending support member while at the same time imparting a high vibration loss factor to the isolator. In FIG. 6 a hinge means functions as the vibration isolation means. Said hinge means is preferably made of steel but can be made of other materials which impart the desired vibration loss factor and rigidity to the isolation means. Finally, FIG. 7 illustrates yet another embodiment of the isolation means and threaded members depicted in FIGS. 3 and 4.

While the present invention has been described in some detail by way of illustration for purposes of understanding, it will be apparent that certain changes and modifications may be practiced within the scope of the appended claims.

We claim:

1. A permanent stud wall structure having improved sound transmission loss comprising:

a. Two substantially parallel rows of spaced apart vertically extending support members secured at their respective ends to a base and header by appropriate means and defining a stud cavity;

b. Said vertically extending support members being located in each of said rows such that there is a corresponding support member in the other row that is in substantially the same plane running perpendicular to said rows;

c. One or more horizontally extending relatively rigid support members extending between one or more corresponding vertically extending support members and being secured to said vertically extending support members by appropriate securing means;

d. Said horizontally extending members including a vibration isolator means to reduce the transmission of sound between opposite ends thereof; and e. One or more layers of a covering material secured to the outwardly facing surfaces of one or more of said vertically extending support members such that said covering material extends in a plane that is substantially parallel to said rows of spaced apart vertically extending support members.

2. The stud wall structure of claim 1 having a sufficient amount of an acoustical insulation material being placed in the internal air space defined by said stud cavity to impart a beneficial sound transmission loss to said wall structure.

3. The stud wall structure of claim 1 wherein said vertically extending support members comprise steel.

4. The stud wall structure of claim 1 wherein said vertically extending support members comprise wood.

5. The stud wall structure of claim 1 wherein said vertically extending support members comprise plastic.

6. The stud wall structure of claim 1 wherein said vertically extending support members comprise a composite material containing plastic and cellulosic fibers.

7. The stud wall structure of claim 1 wherein said horizontally extending support members comprise two or more sections separated by a vibration isolation means.

8. The wall structure of claim 7 wherein said horizontally extending support members comprise steel.

9. The wall structure of claim 7 wherein said vibration isolator means comprises a rubber member secured by appropriate securing means between opposed sections of said horizontally extending support members.

10. The wall structure of claim 1 wherein said vibration isolator means comprises a spring means.

11. The wall structure of claim 1 wherein said vibration isolation means comprises a steel spring means.

12. The wall structure of claim 1 wherein said vibration isolator means comprises a hinge means.

13. The wall structure of claim 1 wherein said vibration isolator means comprises a steel hinge means.

14. A Building structure including the permanent wall structure of claim 1.

15. A multiplex theater complex including the permanent wall structure of claim 1.

* * * * *